United States Patent [19]

Bruno et al.

[11] 4,437,944

[45] Mar. 20, 1984

[54] PROCESS OF MAKING LONG-LIFE THIN METAL PLATE FOR AUTOMOBILE BODIES

[75] Inventors: Roberto Bruno; Massimo Memmi, both of Rome, Italy

[73] Assignee: Zincroksid S.p.A., Turin, Italy

[21] Appl. No.: 219,112

[22] Filed: Dec. 22, 1980

Related U.S. Application Data

[63] Continuation-in-part of Ser. No. 173,234, Jul. 28, 1980, abandoned.

[51] Int. Cl.[3] ..... C25D 11/38

[52] U.S. Cl. ..... 204/27; 204/28; 204/38 B; 204/40; 204/56 R

[58] Field of Search ..... 204/181 R, 181 C, 181 T, 204/27, 28, 32 R, 35 R, 38 R, 38 E, 40, 38 B

[56] References Cited

U.S. PATENT DOCUMENTS

| | | | |
|---|---|---|---|
| 3,257,295 | 6/1966 | Yonezaki et al. | 204/56 R |
| 3,501,278 | 3/1970 | Uchida et al. | 204/41 |
| 3,679,554 | 7/1972 | Yamagishi et al. | 204/56 |
| 3,816,082 | 6/1974 | Austin et al. | 29/183.5 |
| 3,901,771 | 8/1975 | Froman et al. | 204/28 |
| 3,954,571 | 5/1976 | Eppensteiner et al. | 204/28 |
| 3,989,604 | 11/1976 | Austin | 204/28 |
| 4,048,381 | 9/1977 | Adaniya et al. | 428/632 |
| 4,101,345 | 7/1978 | Hunter | 427/433 |

OTHER PUBLICATIONS

F. A. Lowenheim, *Electroplating,* McGraw-Hill Book Co., New York, 1978, pp. 86-87, 442-446, 449-451.

*Primary Examiner*—G. L. Kaplan
*Assistant Examiner*—William Leader
*Attorney, Agent, or Firm*—Alan H. Levine

[57] ABSTRACT

Thin metal plate is cleaned and electrolytically pickled in an acid solution. A zinc layer is electrodeposited on one face of the plate, after which a chrome-chromic oxide coating is deposited on both faces of the plate from a sulphuric acid solution containing compounds of trivalent and hexavalent chrome. The plate is then subjected to a drying-oxidating treatment in air. The plate may be steel having a thickness between 0.1 and 2 mm. The plate may be surface treated by phosphating, and then painted. The chrome-chromic oxide coating may have a thickness between 0.05 and 5 μm, and the zinc coating a thickness between 1 and 30 μm.

5 Claims, No Drawings

PROCESS OF MAKING LONG-LIFE THIN METAL PLATE FOR AUTOMOBILE BODIES

This application is a continuation-in-part of copending application Ser. No. 173,234, filed July 28, 1980 now abandoned.

The present invention has as its object the provision of a special thin metal plate for a motor vehicle body of long life. More precisely, the present invention refers to the problem of protecting from corrosion the metallic structures which form the body in general and, particularly, the underbody.

The subject matter of present invention is in effect a process based on the principle of submitting the thin plate, before its forming and painting, to a zinc plating of one of its faces followed by depositing on both faces a coating layer based on chrome-chromic oxide. There is so obtained, operating under particular working conditions, a composite product having a high resistance to underpellicular corrosion on the zinc-coated part and a high intrinsic strength on the other part.

Protection against corrosion is, as known, a problem which arises in the motor vehicle industry in connection with obtaining long endurance of the metallic structures forming the body. The painting techniques at present used in the motor vehicle industry are such as to practically limit painting to external parts only, particularly in the case of boxed components. From the above statements, it is evident that the problem requires a different approach depending upon whether the face under consideration is an external face (painted) or an internal face (non-painted). In the first case, the problem is to increase the underpellicular corrosion strength of the painted thin plate, while in the second case, the problem becomes the increase of the corrosion strength of the non-painted surface.

In the past, the improvement of the underpellicular corrosion strength was obtained through finishing of thin plates with surfaces which were checked as to their chemical and metallurgical cleanliness (elimination of carbon inclusions, etc.). Such methods encountered, nevertheless, a serious limitation because their effectiveness was subject to the immediate utilization of the thin plate, and this condition occurred only very seldom.

Concerning the protection of the non-painted parts, such parts were, in the past, covered by utilizing particular painting techniques with paints having a high penetrating power or protected by having recourse to carefully studied drawings of the body.

In the first case, being the use of such paints subordinated also to the body drawing, there was nevertheless the drawback that, (particularly when priming electropainting with electrophoretic paints) the filiform corrosion phenomenon of the steel was enhanced. In the second case, the more frequent planning modifications are: (a) the presence of metallic watertight joints, sealed with suitable mastics, the lap joints being protected by rims; (b) the presence of suitable drainage devices for the doors and the body parts with non-fixed windows. The most serious drawback encountered by these operative criteria is the subordination of the project assembly to the design of the single parts.

The present invention overcomes the drawbacks described above and offers further advantages which will be specified below.

The process according to the invention comprises submitting a thin metal plate having a thickness between 0.1 and 2 mm to the effects of the following operations applied in combination:

- a surface cleaning treatment with any conventional technique;
- electrolytic pickling with an acid solution;
- electro-deposition of a zinc layer from a conventional acid bath according to the one-side deposition technique;
- washing in deionized $H_2O$ according to known methodologies;
- the deposition at least on one side of a coating flash based on Chrome-Chromic oxide from an acid solution with $H_2SO_4$, containing trivalent and hexavalent chrome compounds; and
- an air drying-oxidation treatment.

The electrolytic pickling is effected in an aqueous solution of $H_2SO_4$ at a concentration between 1% and 10% by weight. The pickling temperature is chosen between 20° and 100° C. The treatment times vary from 10 to 60 seconds. The current density through the cell is between 5 and 20 A/dm$^2$.

The thickness of the Zn one-side coating is between 1 and 30 $\mu$m.

The deposition of the chrome-chromic oxide coating flash is obtained from an acid solution with sulphuric acid at a concentration between 0.05 and 1 ml of $H_2SO_4$ at 96% per each liter of solution. The solution also contains substantially from 20 to 100 g/liter of $CrO_3$ and from 0.5 to 3 g/liter of $CrF_3$. The temperature of the solution during the deposition is between 30° and 80° C. The treatment time is selected between 1 to 10 seconds. The cathodic current density during the deposition process is between 5 and 100 A/dm$^2$. The thickness of the chrome-chromic oxide coating is between 0.05 and 5 $\mu$m.

The invention is not limited to the production process but it extends also to the thin plate obtained. The thin plate is characterized by having a thickness between 0.1 and 2 mm, one face being coated with a layer of chrome-chromic oxide having a thickness between 0.05 and 5 $\mu$m, and the other face coated with a first layer of zinc having a thickness between 1 and 30 $\mu$m and a second layer of chrome-chromic oxide having a thickness between 0.05 and 5 $\mu$m. The thin plate according to the invention may be left as such or painted.

Having given a general description of the invention, a more detailed one follows with the aid of examples in order to better illustrate its objects, particular features, and advantages. The treatment of each example has been applied to 5 test pieces.

EXAMPLE I

A cold-rolled thin plate of 1 mm thickness having a composition (% in weight) of: C 0.053; Si 0.02; Mn 0.22; P 0.008; S 0.018; Al 0.063; Cu 0.025; N 53 parts per thousand; O 60 ppt; Fe remaining part, is submitted to the following trea..nent according to the invention;

- an electrolytic degreasing in a solution of 25 g/l of NaOH, 25 g/l of $Na_3PO_4$ at 90° C. with a current density of 10 A/dm$^2$ by means of an alternate cycle formed by alternations of 10 cathodic pulses and 10 anodic pulses, each one of a duration of 1 second;
- an electrolytic deposition of a Zn layer from a bath at a pH=3.8 containing 337 g/l of Zn $SO_4$.7 $H_2O$, 29.9 g/l of $NH_4CL$ and 37.5 g/l of $Al_2(SO_4)_3$. 8 $H_2O$, at the temperature of 49° C. and with a current density of 3 A/dm$^2$;

washing in deionized $H_2O$ until the acidity has disappeared;

deposition of a chrome-chromic oxide flash from an aqueous solution containing per liter: 0.10 ml of $H_2SO_4$ at 96%; 0.75 ml of fluoboric acid ($HBF_4$) at 80%; 100 g of $CrO_3$ and 2 g of $CrF_3$. The treatment temperature and time are respectively 50° C. and 3 seconds. The cathodic current density is 20 A/dm$^2$;

air drying at 150° C. for 5 minutes;

a phosphating according to known technique; and electrophoretic painting according to a conventional technique.

EXAMPLE 2

A thin plate according to Example 1 is submitted to the same treatment described in that example except the phosphating is not effected.

EXAMPLE 3

A thin plate according to Example 1 is submitted to the same treatment therein described but with modifications of the conditions corresponding to the effectuation of the chrome-chromic oxide layer deposition and the drying. In effect, the composition of the solution providing the deposition is per liter: 80 g of $CrO_3$; 1.5 g of $CrF_3$; 0.5 ml of $H_2SO_4$ at 96%; 0.5 ml of $HBF_4$ at 80%. Further, the bath temperature is 33° C. while the current density is 15 A/dm$^2$. The treatment time is 4 sec. The drying has been effected in air at 90° C. for 10 minutes.

EXAMPLE 4

The treatment of Example 3 has been effected on the same thin plate of the preceding examples with the only exception that the test pieces have not been submitted to the phosphating.

The following Table 1 shows the results of the corrosion tests concerning the test pieces treated according to Examples 1 to 4 and reference test pieces prepared as specified in the Table. The corrosion tests have been effected by exposing the painted test pieces, with a cross incision, to a salty fog (a solution of NaCl at 5%) during 500 hours according to rule ASTM B 117.

TABLE 1

| Test pieces | Judgment |
|---|---|
| 5 test pieces of Example 1<br>4 test pieces of Example 2<br>4 test pieces of Example 3<br>4 test pieces of Example 4 | Absence of underpellicular corrosion;<br>Absence of blisters |
| 1 test piece of Example 2<br>1 test piece of Example 3<br>1 test piece of Example 4 | A beginning of underpellicular corrosion; only a few blisters |
| 5 reference test pieces phosphated and painted with electrophoretic treatment (EDP) with electrolytic cleaning before the phosphating | Severe underpellicular corrosion; only a few blisters |
| 5 reference test pieces phosphated and painted with EDP with electrolytic cleaning before the annealing | Severe underpellicular corrosion; many blisters |
| 5 reference test pieces phosphated and painted with EDP without any electrolytic cleaning treatment | Very severe generalized corrosion |

We claim:

1. A process for producing sheet steel for long life motor vehicle bodies, comprising the steps of:

depositing a layer of zinc on only one face of the sheet steel, and thereafter simultaneously applying to both faces of the sheet steel a chrome-chromic oxide coating, said coating being applied by electrodeposition from an aqueous solution comprising, per liter: from 0.05 to 1 ml of $H_2SO_4$ at 96%; from 20 to 100 g of $CrO_3$; and from 0.5 to 3 g of $CrF_3$.

2. A process according to claim 1, characterized in that the thin plate has a thickness between 0.1 and 2 mm.

3. A process according to claim 1, characterized by the deposition of the chrome-chromic oxide occurring at a temperature between 30° and 80° C.

4. A process according to claim 3, characterized by the deposition time for the chrome-chromic oxide being between 1 and 10 seconds.

5. A process according to claim 4 characterized by the cathodic current density during the deposition of said chrome-chromic oxide being between 5 and 100 A/dm$^2$.

* * * * *